United States Patent [19]

Thalenfeld

[11] 4,319,730

[45] Mar. 16, 1982

[54] SELF-LOCKING MERCHANDISE HOOK

[75] Inventor: David R. Thalenfeld, Beachurst, N.Y.

[73] Assignee: Trion Industries Inc., Garden City, N.Y.

[21] Appl. No.: 117,459

[22] Filed: Feb. 1, 1980

[51] Int. Cl.[3] ..... E04G 5/06; F16L 3/08

[52] U.S. Cl. ..... 248/220.4; 248/221.3

[58] Field of Search ..... 248/220.2, 220.3, 220.4, 248/221.1, 221.2, 221.3; 211/86, 87

[56] References Cited

U.S. PATENT DOCUMENTS

| | | | |
|---|---|---|---|
| 2,987,286 | 6/1961 | Alling . | |
| 3,452,954 | 7/1969 | Lucietto et al. . | |
| 3,477,677 | 11/1969 | Hindley | 248/220.3 |
| 3,516,634 | 6/1970 | Salava et al. . | |
| 3,724,792 | 4/1973 | Thalenfeld | 248/220.4 |
| 3,880,390 | 4/1975 | Niven | 248/222.3 X |
| 3,897,926 | 8/1975 | Silver | 248/221.1 |
| 3,926,395 | 12/1975 | Lallement . | |
| 3,964,712 | 6/1976 | Staudte | 248/222.1 |

FOREIGN PATENT DOCUMENTS

| | | | |
|---|---|---|---|
| 258524 | 11/1967 | Austria | 248/220.3 |
| 1472212 | 1/1967 | France | 248/220.3 |

*Primary Examiner*—J. Franklin Foss

*Attorney, Agent, or Firm*—Mandeville and Schweitzer

[57] ABSTRACT

The disclosure is directed to a self-locking merchandise hook for mounting on perforated panel board, preventing accidental dislodgement of the hook from its mounted position. In its most advantageous form, the merchandise hook is a single piece molding of all plastic material, including integral plastic hook and base portions, as well as integral mounting lugs. In other forms, the hook may comprise more than one part. In all forms, a self-locking feature is provided in the form of an upwardly extending, flexible resilient tongue, which overlies the front face of a perforated panel board, on which the merchandise hook is mounted. In order to mount or demount the merchandise hook, the locking tongue must be resiliently deflected by the application of at least modest external force. Although intentional mounting and demounting requires no additional action or manipulation, unintentional dislodgement is virtually eliminated.

7 Claims, 7 Drawing Figures

SELF-LOCKING MERCHANDISE HOOK

BACKGROUND AND SUMMARY OF THE INVENTION

In the display and merchandising of small items, merchandisers make widespread use of display hooks mounted on perforated panel board. A wide variety of such panel board display hooks are available to the trade, each having certain attributes deemed desirable to the trade. In most of the widely used forms of merchandise hook, a low production cost is one of the important considerations to commercial success. Typically, merchandise hooks of the type concerned herein include an elongated wire merchandise support element, which is attached to a base member or base assembly, which may be formed of metal plate, plastic or, in many cases, wire.

In the most preferred form of the present invention, an entire merchandise hook is formed as a unitary molding of a structural plastic material, providing for an extremely lightweight, low cost display hook. In addition to cost and production advantages, the unitary, all plastic merchandise hook has important safety advantages, because of the inherent resiliency and deflectability of the outwardly extending, elongated merchandise supporting element.

The inherent resilience and deflectability of the integral merchandise support element has, notwithstanding its important safety advantages, represented a major obstacle to the commercialization of a one piece, all plastic merchandise hook. In this respect, because of the inherent lightness in weight of an all plastic hook, and the substantial resilience and elasticity in the projecting merchandise supporting portion thereof, accidental contact with, and deflection of the merchandise support element could result in the entire merchandise hook aand its content being catapulted out of its mounting holes in the perforated panel display board. In accordance with an important feature of the present invention, however, a single piece, all plastic molded display hook incorporates an integral, self-locking element which, while effectively preventing accidental dislodgement of the display hook from a panel board, permits easy mounting and demounting of the hook without time consuming extra manipulations. In addition, the self-locking feature may be incorporated integrally into the molded, one piece unit without consequential additional cost.

More specifically, the self-locking feature includes the provision of an integral, flexible tongue, extending upwardly from the back edge portion of the base element, so as to overlie the front surface of the perforated panel board, more or less in opposed relation to the L-shaped mounting lugs by which the device is secured to the panel. The configuration and location of the resilient locking tongue is such that the tongue must be resiliently deflected in order to either insert the device into mounted position on a panel board or to remove it. The inherent resilience of the plastic material permits the locking tongue to be flexed out of the way to accommodate the mounting and demounting operations, but nevertheless effectively resists any accidental dislodgement of the device by reason of a momentary, unintended contact. The provision of the self-locking feature makes possible and practical the manufacture of a panel board merchandise hook as a one piece molding of structural plastic material.

Athough the invention is considered to have perhaps its greatest usefulness in conjunction with a one piece plastic molded device, the important advantages of the self-locking feature may be realized in other constructions of merchandise hooks. For example, in one well known, commercially available form of merchandise hook, a wire merchandise supporting element is associated with a molded plastic base. In accordance with one aspect of the invention, the molded plastic base of such a unit may be provided with an integral, upwardly extending flexible locking tongue, rendering the unit self-locking without consequential increase in the manufacturing cost.

In another advantageous form of the invention, a known form of all-metal pegboard hook, having a flat, sheet metal type base member, is provided with a self-locking feature by means of a simple, inexpensive, plastic attachment which forms an upwardly extending, resilient locking tongue. To advantage, the plastic attachment may be manufactured in the form of a continuous extruded shape, which is cut to length and applied to the otherwise conventional display hook.

In other contemplated forms of the invention, a base member may be formed of spring steel or other metal having sufficient inherent resilience to enable a flexible self-locking tongue to be provided as an integral part of the metal base.

REPRESENTATIVE PRIOR ART

Various arrangements have been proposed heretofore either locking a merchandise display hook in position on a perforated panel board, or resisting its accidental removal. Representative such arrangements are shown in, for example, the Staudte, Jr. U.S. Pat. No. 3,964,712, the Lallement U.S. Pat. No. 3,926,395, the Scheneman U.S. Pat. No. 3,545,711, the Salava et al. U.S. Pat. No. 3,516,634, the Hindley U.S. Pat. No. 3,477,677, the Lucietto et al. U.S. Pat. No. 3,452,954 and the Alling U.S. Pat. No. 2,987,286. None of these known arrangements, however, provides either the simplicity or the overall usefulness and effectiveness of the present invention.

For a more complete understanding of the above and other features and advantages of the invention, reference should be made to the following detailed description of preferred embodiments of the invention and to the accompanying drawing.

DESCRIPTION OF PREFERRED EMBODIMENTS OF THE INVENTION

Figure 1:
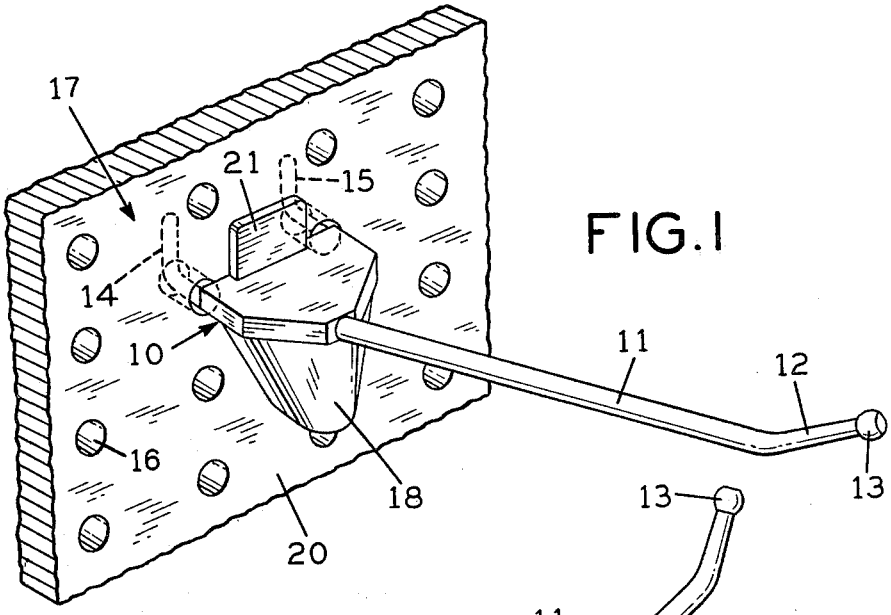
FIG. 1 is a perspective view illustrating a molded, all plastic, self-locking merchandise hook mounted on a perforated panel display board.
Figure 2:
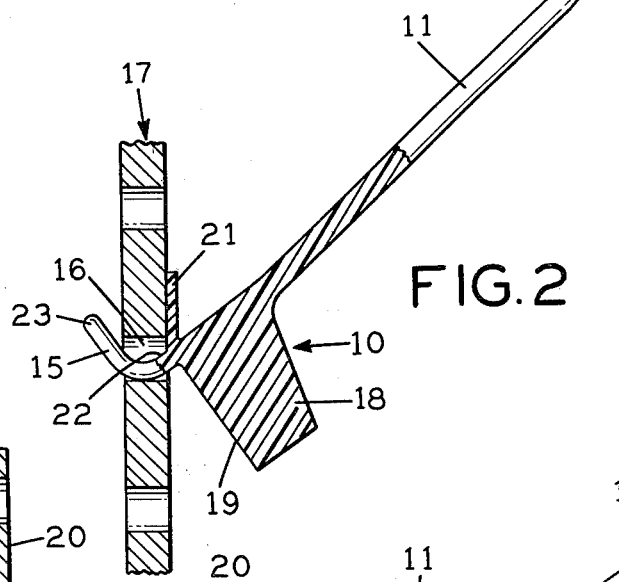
FIG. 2 is a cross sectional view of the device of FIG. 1, illustrating the manner in which the device is mounted or demounted from the perforated panel board.
Figure 3:
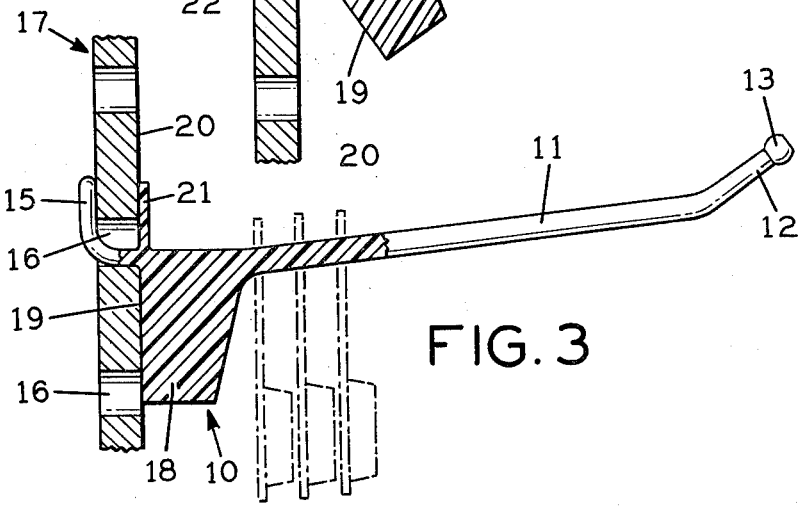
FIG. 3 is a cross sectional view, similar to FIG. 2, but showing the device in its normal, mounted position.

Referring now to the drawings, and initially to FIGS. 1-3 thereof illustrating a basic and most preferred embodiment of the invention, the reference numeal 10 designates generally the base member of an all-plastic, injection molded merchandise hook according to the invention. An elongated merchandise supporting element 11 projects forwardly and typically slightly upward from the base member 10, terminating in an upturned end portion 12, typically provided with a balled end 13. Projecting rearwardly from the upper rear portion of the base 10 are laterally spaced, L-shaped mounting lugs 14, 15 which are of a size and shape to be projectable through spaced openings 16 in a standard perforated panel board 17 of the type commonly used for panel board display purposes. A portion 18 of the base member 10 extends downward from the mounting lugs and forms a support surface 19 arranged to bear against the front surface 20 of the panel board to stabilize the hanger device in its mounted position.

In accordance with an important aspect of the invention, the entire hanger device shown in FIG. 1 is a single, unitary molding, typically an injection molding, of a suitable structural plastic material such as, for example, nylon. The unit is inexpensive and extremely lightweight, and can be economically mass produced by multiple injection molding techniques which are, in themselves, well known. A device of this construction has many important advantages. Among these is a high degree of resilience and deflectability of the projecting merchandise support element 11. This provides a high degree of safety against injury resulting from accidental contact with the projecting element, and is very desirable from that standpoint, among others. A disadvantage inherent in a device possessing such resiliency is the possibility of being accidentally brushed by a customer and, upon release, being catapulted out of its mounted position on the panel board, because of the energy release in the resilient merchandise support element 11.

In accordance with the present invention, a novel, highly effective, yet simplified arrangement is provided for imparting a self-locking characteristic to the display hook whereby unintended demounting or detachment of the device is virtually precluded, yet intentional mounting or demounting of the device may be accomplished as easily and quickly as with conventional devices. More specifically, the device of the invention includes an integral locking tongue 21, relatively thin and flexible in nature, which extends upward from the upper rear extremities of the base member 10 so as to overlie the front surface 20 of the panel board in the normal, mounted position of the display hook. Conveniently, in the illustrated form of the invention, the locking tongue 21 is positioned centrally on the upper rear portion of the base member, generally between the two L-shaped mounting lugs 14, 15. It will be understood, however, that, where circumstances warrant, the locking tongue may be located elsewhere; for example, spaced locking tongues could be positioned outside of and in straddling relation to the L-shaped lugs. The principal requirement is that the locking tongue extend upwardly from a point approximately at or below the level of the horizontal portions 22 of the mounting lugs.

The horizontal, front-to-back spacing between the back surface of the locking tongue 21 and the front facing surfaces of the mounting lugs 14, 15 is at least approximately as great as the thickness of the panel board, and typically somewhat greater. As is reflected particularly in FIG. 2, the height of the locking tongue 21 is such that, when the device is tilted upwardly to accommodate entry of the vertical portions of the mounting lugs into the panel board apertures 16, the upper portions of the locking tongue 21 engage the front surface of the panel board and resist such entry. In order to fully insert the mounting lugs, sufficient rearward pressure has to be applied to the device to deflect the resilient locking tongue forwardly, as shown in FIG. 2. After the locking lugs have entered the apertures, the device may be released, and it will swing downward into its normal mounting position, as shown in FIGS. 1 and 3. In that normal position, the locking tongue 21 overlies the front surface of the panel board. In the illustrated of FIG. 3, the panel board 17 is substantially as thick as the spacing between the mounting lugs 14, 15 and the locking tongue 21. However, quite typically, the panel board might be somewhat thinner. In accordance with the invention, however, in all cases, the relationship of the panel board thickness to the spacing between the mounting lugs and locking tongue, and to the height of the tongue, is such that forward deflection of the mounting tongue is required in order to insert the display hook into its mounted position, as shown in FIG. 2.

Just as forward deflection of the locking tongue 21 is required in order to mount the device, similar forward deflection of the locking tongue, against its normal resilient restraining force, is required in order to remove or demount the device. In other words, in order to remove it, it has to be pivoted upwardly, more or less in the same position shown in FIG. 2, before the mounting lugs 14, 15 can be withdrawn through the panel board opening 16. As a result, removal of the device from its mounted position requires a sustained upward pivoting force upon the device, in order to bring out the necessary forward deflection of the locking tongue. Mere accidental bumping of the device, even though involving a deflection and release of the merchandise support element 11, normally is not sufficient to accidentally dislodge the device. For all practical purposes, it can be removed only by intentional actions.

As will be understood, the provision of the integral locking tongue 21 adds only insignificantly to the amount of plastic material utilized in the overall device and thus is of little or no cost consequence in the manufacture thereof. Outstanding advantages are derived therefrom, however, in that its provision makes practical for the first time the use of an all-plastic, injection molded, one piece display hook. While the desirability and general advantages of such a device has been known for some time, it has not been practicable heretofore to use a one piece, molded plastic device, because of its tendency for accidental dislodgement from the display board. Any savings and advantages were more than offset by the inconvenience and expense of dealing with the frequent accidental dislodgement.

Figure 4:
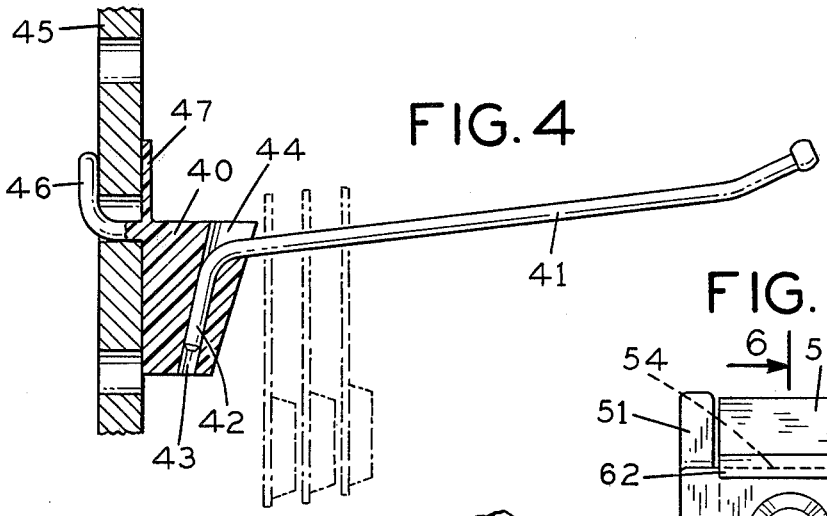
FIG. 4 is a longitudinal cross sectional view of a modified form of the invention comprising a molded plastic base section in conjunction with a removable wire merchandise support.

In the form of the invention shown in FIG. 4, the base member 40 is formed of molded plastic material, much in the form of the base portion 10 of FIG. 1. However, in the modification of FIG. 4, the merchandise supporting element 41 is formed of wire, rather than plastic. The wire support element is provided at its inner end with a downwardly extending mounting leg 42, which is received in a cylindrical socket 43 formed in the base member. A slot 44 in the upper portion of the base member receives an inner portion of the merchandise support member 41 to secure the member in a predetermined rotational orientation, typically at 90 degrees with respect to a panel board 45 on which the device is mounted.

The plastic base member 40 includes integral L-shaped mounting lugs 46 and an integral, upwardly extending, flexible locking tongue 47. The arrangement and relationship of the mounting lugs and locking tongue 47 are basically the same as described with respect to the modification of FIGS. 1-3, and the mounting and demounting operations are exactly the same.

With the two piece device of FIG. 4, it may be convenient in some instances for a rack jobber, for example, to premount base members 40 on a panel board display, in a predetermined, desired arrangement, prior to shipment of the display panel to the utlimate merchandiser. The self-locking characteristics provided by the locking tongue 47 permit the preassembled base elements to be shipped and handled without accidental dislodgement of the base members from their predetermined locations.

Figure 7:
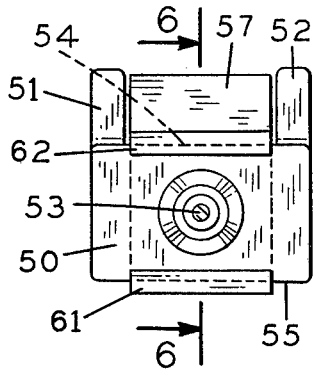
FIG. 7 is a front elevational view of the device of FIG. 5, with parts broken away for clarity.
Figure 5:
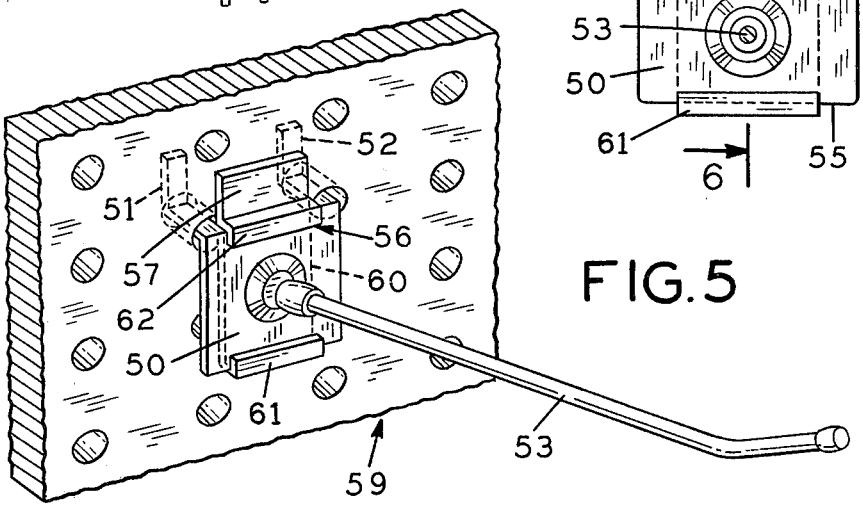
FIG. 5 is a perspective view of a further modified form of the invention, in which the basic merchandise hook may be of otherwise conventional, all metal construction and is provided with a simple, inexpensive attachment to provide self-locking characteristics.
Figure 6:
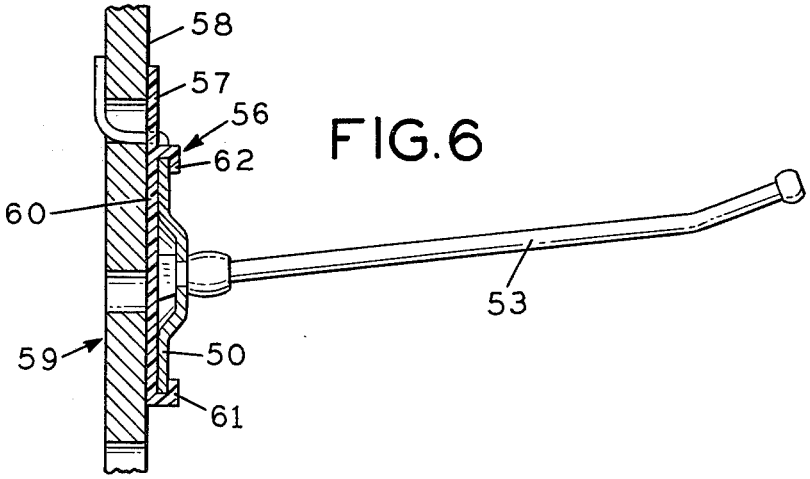
FIG. 6 is a longitudinal cross sectional view of the hook of FIG. 5, substantially as taken on line 6—6 of FIG. 7.

In the modification of FIGS. 5-7, a standard, all-metal merchandise hook is converted by means of a simple attachment to a self-locking hook having many of the functional advantages of the device of FIGS. 1-3 and FIG. 4. In FIG. 5, for example, there is shown an all-metal hook which advantageously may be of the general type described in by prior U.S. Pat. No. 3,724,792 owned by Trion Industries Inc. of Garden City, New York. The merchandise hook referred to includes a stamped-out sheet metal base member 50 which includes integral bent mounting lugs 51, 52 of the usual form. A separate wire merchandise supporting element 53 is secured to the sheet metal base member 50, advantageously by techniques described in the before mentioned U.S. Pat. No. 3,724,792.

For the purposes of the present invention, the sheet metal base plate 50 is provided with relatively straight, parallel upper and lower edges 54, 55 in the region between the spaced L-shaped mounting lugs 51, 52. A locking element 56 is secured to the base member 50 and includes an integral, flexible resilient locking tongue element 57 extending upwardly from the region of the upper edge 54 of the base plate and adapted to overlie the front surface 58 of a section of perforated panel board 59, substantially as indicated in FIG. 6.

To advantage, the locking device 56 is in the form of an extruded plastic section, formed of a suitably strong, resilient plastic material. The extruded section includes a flat body 60 provided at spaced points with upwardly and downwardly projecting mounting flanges 61, 62 respectively, which form pockets for reception of the bottom and top edges respectively of the base plate 50. The locking tongue 57 forms, in effect, a continuation of the flat body section 60, as is indicated in FIG. 6.

As will be understood, the extruded section may be produced in continuous length, by standard plastic extrusion processes, and then cut to appropriate length to suit the end use. Desirably, the length of the individual locking devices 56 is substantially as great as can be accommodated between the spaced mounting lugs 51, 52, in order to provide maximum contact area with the panel board 59 and maximum stability of the device in its mounted position.

As reflected particularly in FIG. 6, the locking attachment extends along the entire back of the base plate 50, and is interposed between the base plate and the panel board 59. Accordingly, the thickness dimensions of the body portion 60 and locking tongue extension 57 are as small as practicable, consistent with providing for sufficient resilient strength in the locking tongue portion 57 to impart effective self-locking characteristics to the device.

For assembly of the locking devices 56 to the base plates 50, it is contemplated there will be sufficient flexibility in the material of the locking device to permit the flanges 61, 62 to be manually snapped over the upper and lower edges of the base plate. In use, the locking device is self-retaining on the base plate 50, as will be understood.

As will be appreciated from the foregoing description, the basic principles of the invention are capable of being incorporated in a wide variety of specific embodiments, permitting a wide latitude of design. By way of further example, it is contemplated that the base member, and perhaps the entire unit, may be formed of an appropriate stamping of spring steel material, in which an upwardly extending locking tongue element is formed integrally by a tongue of the spring steel material.

In any of its various forms, the device of the invention has a unique self-locking characteristic, which permits easy mounting and demounting of the device without extra operations and without any greater difficulty than is involved with a purely conventional device, yet the self-locking feature effectively prevents accidental dislodgement or demounting of the device. One advantageous use of the self-locking device is in the preassembly of display boards with the merchandise hooks premounted in positions considered to most attractively and efficiently present the merchandise for sale. The display boards can be shipped to the ultimate point of sale without concern for the premounted hooks being accidentally dislodged in transit or during assembly at the ultimate sales location.

Of particular advantage is the all-plastic form of the invention shown in FIGS. 1-3. Because of the provision of the self-locking feature, it becomes feasible for the first time to provide a panel board merchandise hook in an all-plastic form. The desirability of such devices has, of course, been indicated for some time. However, they have not been commercially practical heretofore, because of an unfortunate tendency to become accidentally dislodged from the panel board. With the addition of the new, integral locking tongue, however, the device, once mounted, is reliably retained in its mounted position.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. In a merchandise display device of the type having a base member, panel engaging lugs extending rearwardly and upward from the upper back edge area of said base member, and merchandise support means extending forwardly from said base member, the improvement which comprises (a) a resilient, flexible locking tongue mounted in fixed relation to said base member and extending upwardly from the upper back edge of said base member and adapted to overlie the front surface of a perforated panel board, (b) said locking tongue being resiliently deflectable in a forward direction to accommodate mounting and demounting of said display device by forward flexation while substantially preventing unintentional dislodgement of the display device from a panel board.

2. A mechandise display device according to claim 1, further characterized by (a) said base member being molded of a plastic material having properties of resilience, (b) said locking tongue being molded integrally with said base member.

3. A merchandise display device according to claim 2, further characterized by (a) said device comprising an entire integral unit, including said base member and said merchandise support means being a single, integral molding of said plastic material.

4. A mechandise display device according to claim 1, further characterized by (a) said base member being formed of relatively non-resilient material, (b) a locking member, formed of resilient material, detachably secured to said base member but fixed thereto during mounting and demounting of said display device, (c) said locking member including an integral, upwardly extending, locking tongue portion.

5. A one-piece molded plastic merchandise hook, comprising (a) a base member provided with mounting lugs, (b) an integral outwardly extending merchandise support element, and (c) an integral, upwardly extending, resilient, flexible locking tongue extending upward from said base member, (d) said locking tongue being resiliently deflectable in a forward direction to accommodate mounting and demounting of said display device by forward flexation while substantially preventing unintentional dislodgement of the display device from a panel board.

6. A merchandise display device comprising, (a) a base member provided with mounting lugs, (b) said base being adapted to mount a merchandise support element, (c) an integral, upwardly extending, resilient, flexible locking tongue extending upward from said base member, (d) said locking tongue being resiliently deflectable in a forward direction to accommodate mounting and demounting of said display device by forward flexation while substantially preventing unintentional dislodgement of the display device from a panel board.

7. A self-locking merchandise hook comprising, (a) a flat, rigid plate-like base member, (b) a pair of spaced-apart L-shaped mounting lugs extending rearward and upward from the upper edge region of said base member, (c) a merchandise supporting element mounted on and extending outward from said base member, (d) an attachment for imparting self-locking features to a merchandise display hook, (e) said attachment including (i) a finite length section of continuous extrusion of resilient plastic material, (ii) said section comprising a flat body portion and a resilient, flexible locking tongue portion extending therefrom, and (iii) a pair of spaced, opposed, base-plate-engaging flanges on the front face of said body portion, and (f) said attachment extending across said base member between said mounting lugs.

* * * * *